US005514068A

United States Patent [19]

Calvert et al.

[11] Patent Number: 5,514,068

[45] Date of Patent: May 7, 1996

[54] MACHINE AND METHOD FOR ERECTING BASKET STYLE CARTONS

[75] Inventors: Rodney K. Calvert, Dunwoody; Alton J. Fishback, Austell, both of Ga.

[73] Assignee: The Mead Corporation, Dayton, Ohio

[21] Appl. No.: 153,672

[22] Filed: Nov. 16, 1993

[51] Int. Cl.[6] ..... B31B 1/78; B31B 1/80

[52] U.S. Cl. ..... 493/315; 493/312

[58] Field of Search ..... 493/312, 313, 493/315, 316, 317, 318, 181

[56] References Cited

U.S. PATENT DOCUMENTS 2,780,148 2/1957 Pearson et al. .

2,780,970 2/1957 Gentry .

3,027,815 4/1962 Anness et al. .

3,343,466 9/1967 Sherman .

*Primary Examiner*—Bruce M. Kisliuk

*Assistant Examiner*—Christopher W. Day

*Attorney, Agent, or Firm*—Rodgers & Rodgers

[57] ABSTRACT

A basket style carton is set up by a machine which imparts inward movement to one end wall so as to allow the adjacent locking tab to clear the associated end notch. A first pusher engages the bottom wall and allows the notch to receive the locking tab. Continued inward movement imparted to the one carton end wall causes the locking tab at the opposite end of the bottom wall to clear the associated notch. A second pusher then depresses the bottom wall and allows the associated locking tab to clear the associated notch.

4 Claims, 4 Drawing Sheets

MACHINE AND METHOD FOR ERECTING BASKET STYLE CARTONS

TECHNICAL FIELD

This invention relates to packaging of primary articles such as bottles in basket style cartons and is more particularly concerned with feeding such cartons in collapsed condition from a hopper and for manipulating the carton elements into set up condition.

BACKGROUND ART

U.S. Pat. No. 3,027,815 issued Apr. 3, 1963 discloses a machine for dispensing and setting up collapsed cartons and includes an abutment plate 346 having an opening 348 to accommodate movement therethrough of an ejectment finger 272.

U.S. Pat. No. 3,343,466 issued Sep. 26, 1967 discloses a carton erector apparatus and process which includes a roller 73 which engages a portion of the bottom of a carton to actuate the carton lock.

U.S. Pat. No. 4,336,878 issued Jun. 29, 1982 and owned by the assignee of this invention discloses and claims a basket style carton having double locks.

U.S. Pat. No. 5,176,612 issued Jan. 5, 1993 and owned by the assignee of this invention discloses and claims a high speed erecting mechanism for use in conjunction with sleeve type open ended cartons.

SUMMARY OF THE INVENTION

According to this invention in one form, a machine for erecting collapsed basket style cartons includes carton pick up means for engaging one side wall of a collapsed carton and for moving the collapsed carton into a position of engagement with movable means engageable with the other side wall of the carton for imparting movement thereto which is in a direction away from the one side wall of the carton together with abutment means for engaging one end wall of the carton and pusher means for sequentially engaging the bottom wall medially thereof and near its ends for aiding in set up operations of the carton.

BEST MODE OF CARRYING OUT THE INVENTION

Figure 3:
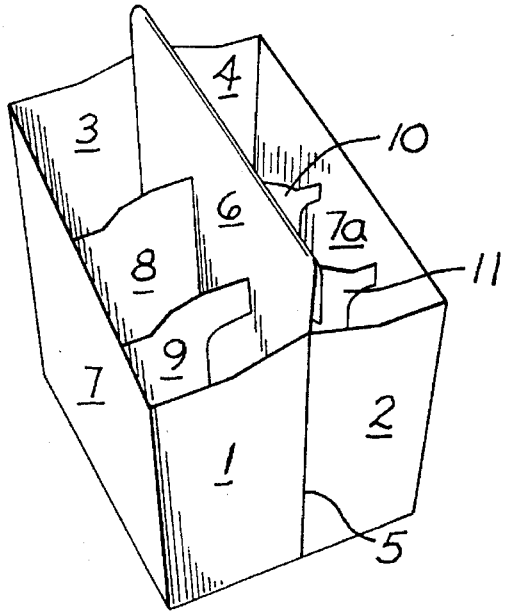
FIG. 3 is a perspective view of a basket style carton which is fully set up and which includes medially collapsible end walls and a medially collapsible bottom wall which is not identified in FIG. 3 together with side walls which coincide with each other when the carton is collapsed as shown in FIG. 2.
Figure 5:
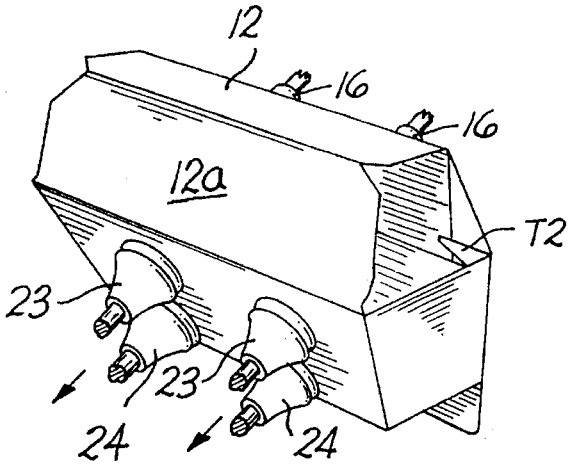
FIGS. 4–8 depict several steps through which a carton is manipulated into set up condition as shown in FIG. 3.

The carton as viewed in FIG. 3 comprises end walls which include panels 1 and 2 at one end of the carton and panels 3 and 4 at the other end of the carton. The medial component of the carrier is designated by the numeral 6 and the side walls are designated by the numerals 7 and **7*a*. Partitions 8 and 9 extend between side wall 7 and medial panel 6 and partitions 10 and 11 extend between side wall 7*a* and medial panel 6**.

Figure 2:
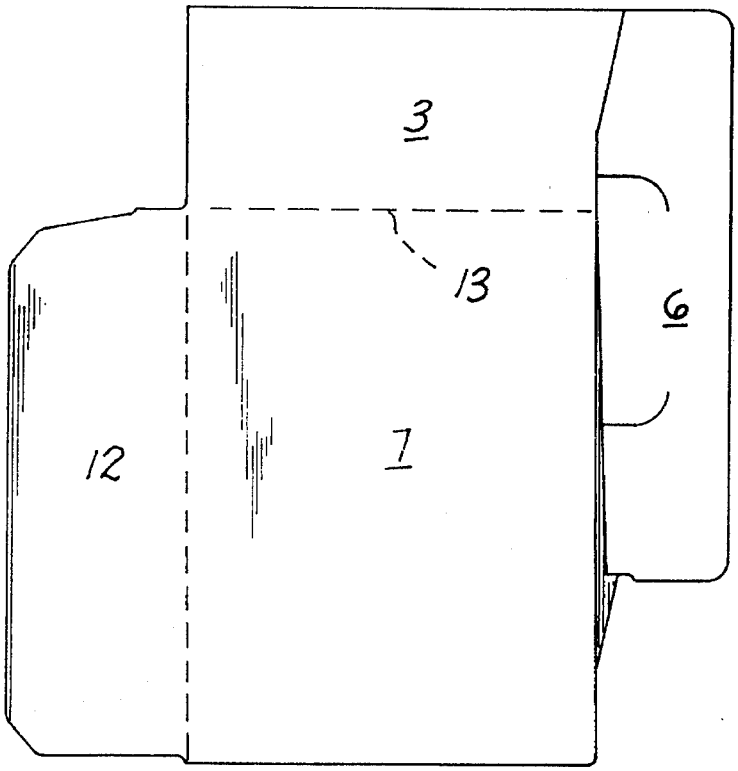
FIG. 2 is an exterior view of a collapsed basket style carton of the type to which this invention is applicable.

When the set up carrier as shown in FIG. 3 is collapsed as shown in FIG. 2, one panel of the collapsed bottom wall 12 is observable and one end panel such as 3 of a collapsed end wall is shown. The upper portion of medial panel 6 is also shown in FIG. 2.

Figure 1:
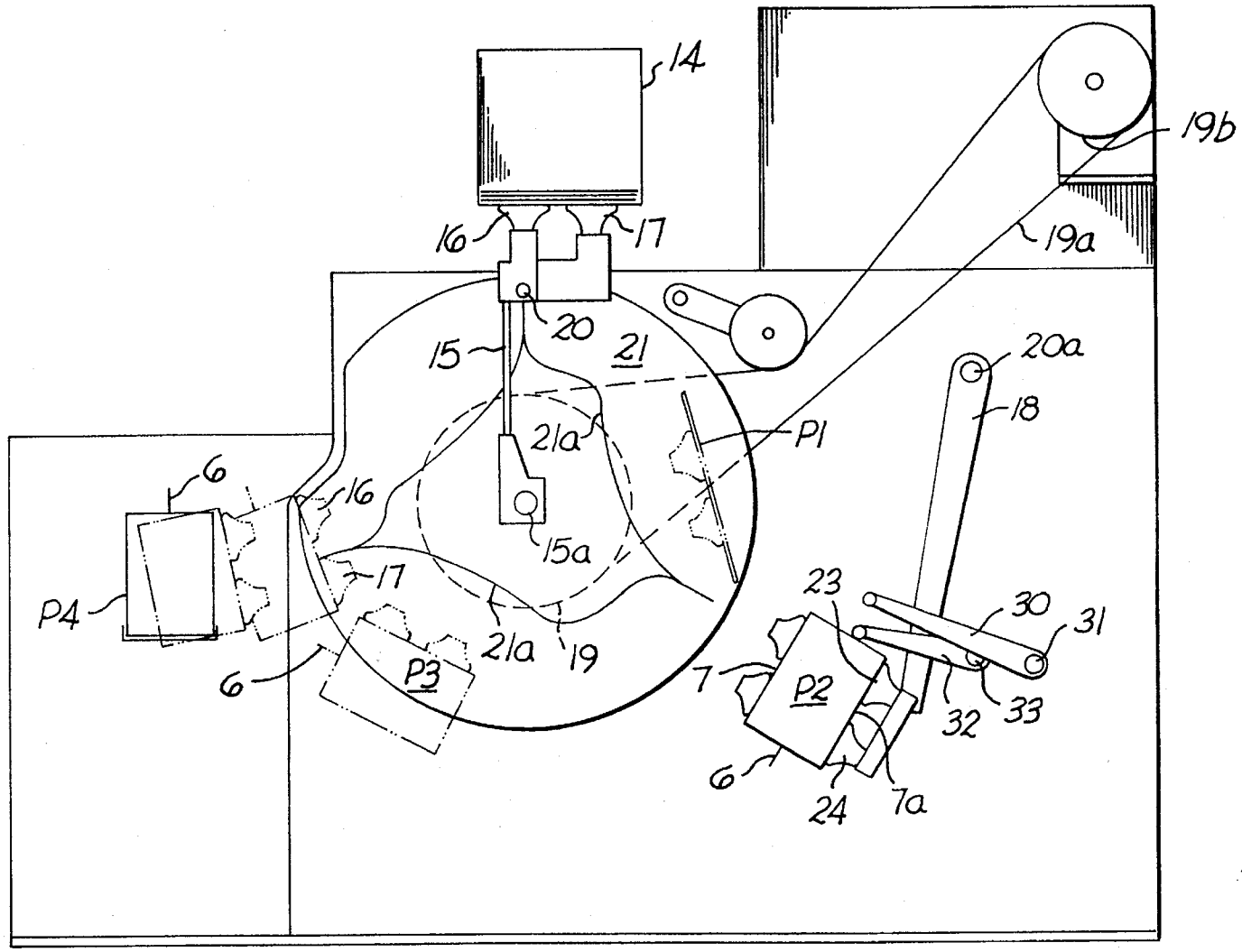
FIG. 1 is a cross sectional schematic representation of the machine formed according to this invention.

In FIG. 1, a stack of collapsed cartons such as are shown in FIG. 2 is disposed within a hopper designated by the numeral 14. The cartons when stacked in the hopper 14 are disposed with the center panel 6, the side wall 7, end wall panel 3 and bottom wall panel 12 disposed as oriented in FIG. 2, i.e., with panel 12 of the bottom wall on the left hand side of hopper 14.

The mechanism including tubular member 15 on which is mounted suction cups 16 and 17 is secured to tubular center shaft **15*a* which supplies suction pressure to member 15. Member 15 is rotatable in a clockwise direction by motive means including drive wheel 19, belt 19*a* and driving wheel 19*b*. A cam follower 20 mounted on rotatable arm 15 rides in cam plate 21 so that when operation is initiated suction pressure applied to suction cups 16 and 17 withdraws the lowermost carton from the hopper 14. The cam follower 20 rides downwardly and toward the right on cam guide 21*a* formed in fixed cam plate 21. The collapsed carton moves through position P1 and thereafter moves to position P2**.

Operation of this cam mechanism is more fully shown in U.S. Pat. No. 4,625,575 issued Dec. 2, 1986 and owned by the assignee of this invention.

The collapsed carton shown in position P1 is moved to the position designated P2 by suction cups 16 and 17 and tubular member 15. Movable means 18 is pivotally mounted at fixed pivot **20*a*. Motive means of known construction and operation causes the arm 18 to move its suction cups 23 and 24 into engagement with exposed side wall 7*a* of the carton and withdraws the inner surface of the carton side wall 7*a* away from the inner surface of side wall 7 so that the carton then occupies the position shown at position P2. The handle 6** of the carton is shown.

Figure 4:
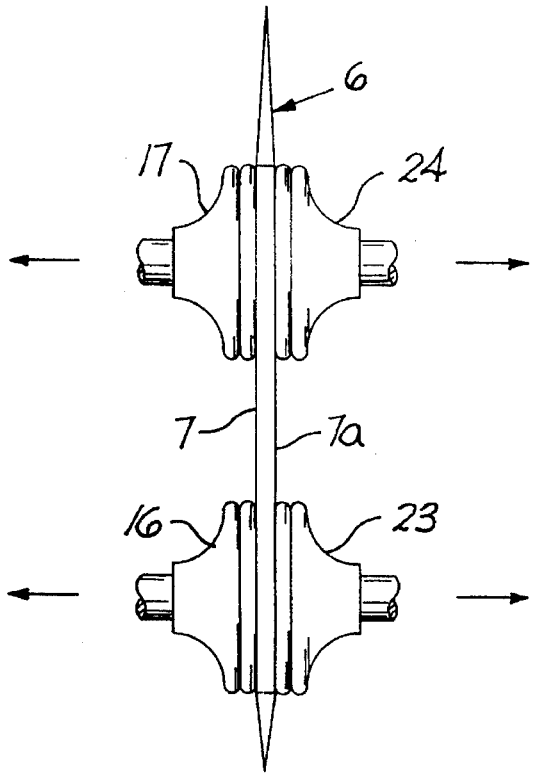

As schematically represented in FIG. 4, the suction cups 16 and 17 are indicated by associated arrows as moving away from the side wall 7. These suction cups 16 and 17 move outwardly once they arrive at position P2 and the pulling action of suction cups 23 and 24 to side wall **7*a*** is indicated by the associated arrows.

In order to initiate setting up of the carrier, the suction cups 23 and 24 move outwardly and the suction cups 16 and 17 move in a direction away from cups 23 and 24.

Figure 8:
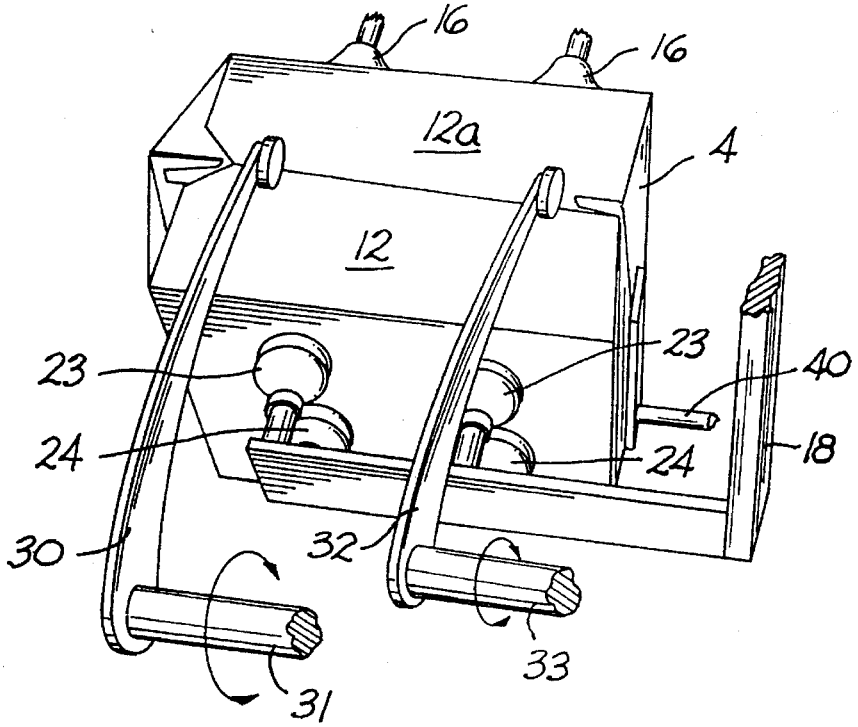

For the purpose of locking the carton as shown at position P2 in FIG. 1 into set up condition a pusher designated by the numeral 30 is mounted on shaft 31 and a second pusher 32 is mounted on shaft 33 as shown in FIG. 8. These pushers are synchronized with the movement of the carton and are actuated by stationary cams (not shown).

Figure 7:
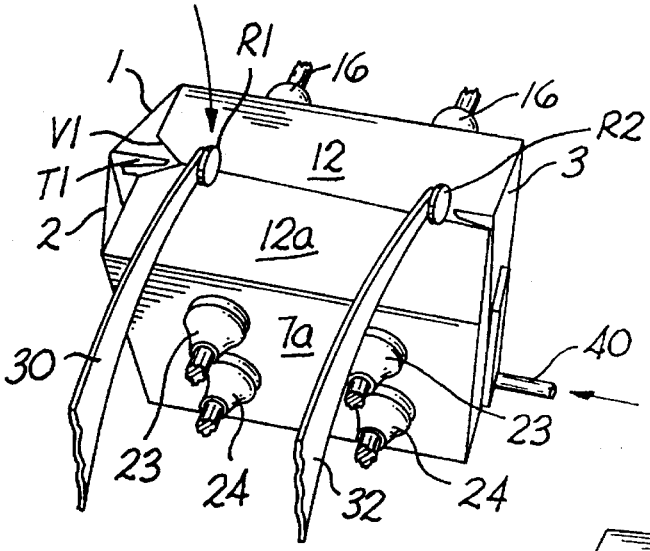
Figure 6:
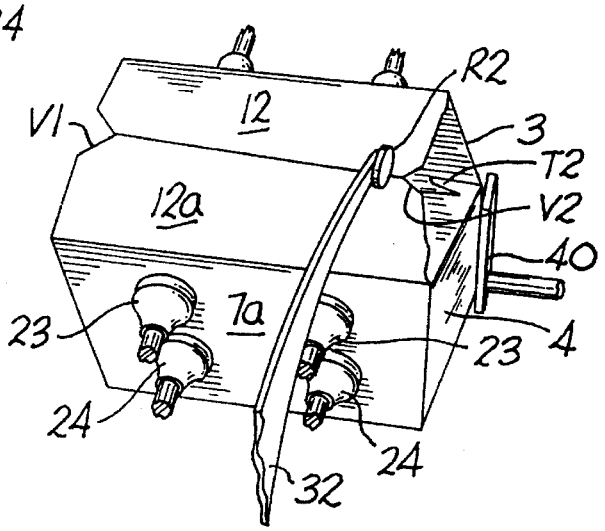

As indicated in FIG. 6 a pusher 40 is movable into engagement with the adjacent end wall panels 3 and 4 and causes the end panels 3 and 4 to move to the left so that notch V2 clears tab T2. Pusher 32 with its roller R2 moves into engagement with the bottom wall to depress this wall and to allow the notch V2 to receive the tab T2. Pusher 40 continues to move end wall panels 3 and 4 to the left as shown in FIG. 7 until notch V1 clears tab T1. Pusher 30 as shown in FIG. 7 causes its roller R1 to engage and depress the bottom panels 12 and **12*a* at their center line to allow the locking tab T1 to move into engagement with the notch V1 of the bottom wall as best shown in FIG. 7. Pushers 30 and 32 maintain engagement with bottom panels 12 and 12***a* as pusher 40 withdraws. Due to "fight" in the board the carton locking tabs remain locked after pushers 30 and 32 withdraw.

Once the carton is in completely locked condition at position P2, suction cups 23 and 24 release control of movement of the carton.

Vacuum cups 16 and 17 retain control of the carton as it is moved through position P3 and into position P4 where it is deposited for loading as vacuum cups 16 and 17 release the carton.

We claim:

1. A machine for setting up a collapsed basket style carton having a medially collapsed bottom wall with medial notches at opposite ends thereof and medially collapsed end walls having locking tabs near the bottom edges thereof and having coinciding side walls, one of said end walls being collapsed to extend outwardly from the associated side walls and the other of said end walls being collapsed to extend inwardly between said side walls, said machine comprising carton pick up means for engaging one of the side walls and for positioning the collapsed carton adjacent movable means engageable with the other of said side walls for imparting movement thereto in a direction away from said one side wall whereby the carton is expanded to a substantially rectangular configuration, a medial abutment element engageable with said one end wall for imparting inward movement thereto sufficient to allow the adjacent locking tab to clear the adjacent notch in the bottom wall, a first pusher element arranged to engage and depress the bottom wall adjacent said one end wall medially thereof so as to allow the notch at the adjacent end of said bottom wall to receive the locking tab associated with said one end wall, and a second pusher element arranged and timed to engage and depress, upon continued inward movement of said one end wall, the bottom wall at the opposite end thereof to allow the locking tab associated with said other of said end walls to enter the adjacent notch at said opposite end of the bottom wall.

2. A machine according to claim 1 wherein said carton is formed of paperboard and wherein said medial abutment element is engageable with one of said end walls to impart limited inward movement thereto and to impart limited outward movement to the other of said end walls and wherein pivotally mounted elongated pushers are engageable respectively in sequence with said bottom wall to depress said bottom wall and wherein the carton remains in set up condition following withdrawal of said abutment element due to inherent characteristics of the paperboard.

3. A method for setting up a collapsed basket style carton having a medially collapsed bottom wall with medial notches at opposite ends thereof and medially collapsed end walls having locking tabs near the bottom edges thereof and having coinciding side walls, one of said end walls being collapsed to extend outwardly from the associated side walls and the other of said end walls being collapsed inwardly to extend between said side walls, said method comprising the steps of (a) removing a collapsed carton from a supply by engaging one side wall of said carton by a first suction cup means and moving said collapsed carton to a position adjacent second suction cup means, (b) engaging the other of said coinciding side walls with said second suction cup means and imparting movement thereto in a direction away from said one of said side walls so as to expand the carton to a substantially rectangular configuration whereby the bottom panel assumes a substantially flat condition, (c) imparting inward movement to said one end wall sufficient to allow the associated locking tab to clear said locking notch provided at the adjacent end of the bottom wall, (d) depressing the bottom wall adjacent said one end wall of the carton so as to allow the notch at the adjacent end of said bottom wall to receive the locking tab associated with said one end wall, (e) continuing the inward movement of said one end wall to cause the locking tab extending from said other of said end walls to clear the notch at the opposite end of said bottom wall, (f) depressing the bottom wall adjacent said other of said end walls so as to allow the notch at said opposite end of said bottom wall to receive the locking tab associated with said other of said end wall, (g) releasing said other of said side walls and moving the erected carton to a loading station.

4. A machine for setting up a collapsed basket style carton having a medially collapsed bottom wall with medial notches at opposite ends thereof and medially collapsed end walls having locking tabs near the bottom edges thereof and having coinciding side walls, one of said end walls being collapsed to extend outwardly from the associated side walls and the other of said end walls being collapsed to extend inwardly between said side walls, said machine comprising carton pick up means for engaging one of the side walls and for positioning the collapsed carton adjacent movable means engageable with the other of said side walls for imparting movement thereto in a direction away from said one side wall whereby the carton is expanded to a substantially rectangular configuration, a medial abutment element engageable with said one end wall for imparting inward movement thereto sufficient to allow the adjacent locking tab to clear the adjacent notch in the bottom wall, a first pusher element arranged to engage and depress the bottom wall adjacent said one end wall medially thereof so as to allow the notch at the adjacent end of said bottom wall to receive the locking tab associated with said one end wall, and a second pusher element arranged and timed to engage and depress, upon continued inward movement of said one end wall, the bottom wall at the opposite end thereof to allow the locking tab associated with said other of said end walls to enter the adjacent notch at said opposite end of the bottom wall, said medial abutment element being withdrawn following entry of said tabs into said notches and said pushers being withdrawn in sequence following withdrawal of said medial abutment element.

* * * * *